US005711101A

United States Patent [19]

Mueller et al.

[11] Patent Number: 5,711,101

[45] Date of Patent: Jan. 27, 1998

[54] POP-UP FRAMING DEVICE

[76] Inventors: David C. Mueller, 1727 E. Midway Rd. #6; Daniel R. Coots, 2503 S. Greenview St., both of Appleton, Wis. 54915

[21] Appl. No.: 749,977

[22] Filed: Nov. 15, 1996

[51] Int. Cl.[6] ..... G09F 1/12

[52] U.S. Cl. ..... 40/750; 40/124.16

[58] Field of Search ..... 40/750, 751, 788, 40/789, 539, 124.09, 124.16, 610

[56] References Cited

U.S. PATENT DOCUMENTS

| | | | |
|---|---|---|---|
| 1,524,338 | 1/1925 | Chesney | 40/789 |
| 2,049,165 | 7/1936 | Kellermeier | 40/750 |
| 2,125,424 | 8/1938 | Cloud . | |
| 2,142,826 | 1/1939 | Rosello . | |
| 2,311,218 | 2/1943 | Fandrich . | |
| 2,449,911 | 9/1948 | Roth . | |
| 2,472,166 | 6/1949 | Mathewson . | |
| 2,530,950 | 11/1950 | Ebert et al. . | |
| 2,720,046 | 10/1955 | Decker . | |
| 2,975,905 | 3/1961 | Foland . | |
| 3,029,051 | 4/1962 | Nichols . | |
| 3,226,863 | 1/1966 | Southard . | |
| 3,763,583 | 10/1973 | Gregg . | |
| 5,259,133 | 11/1993 | Burtch . | |
| 5,287,641 | 2/1994 | Showers . | |
| 5,479,732 | 1/1996 | Burtch et al. . | |
| 5,608,977 | 3/1997 | Burtch et al. | 40/610 X |
| 5,613,311 | 3/1997 | Burtch | 40/610 X |

FOREIGN PATENT DOCUMENTS

| | | |
|---|---|---|
| 162551 | 5/1921 | United Kingdom . |
| 881755 | 11/1961 | United Kingdom . |

*Primary Examiner*—Brian K. Green
*Attorney, Agent, or Firm*—Quarles & Brady

[57] ABSTRACT

A collapsible frame is disclosed that is formed from a single foldable blank. Frame and support portions can be moved between a covering configuration wherein the frame is enclosed inside the support and a display configuration wherein the display is supported substantially vertically above the support. The frame portion can have openings on both the front and back sides, if desired.

14 Claims, 4 Drawing Sheets

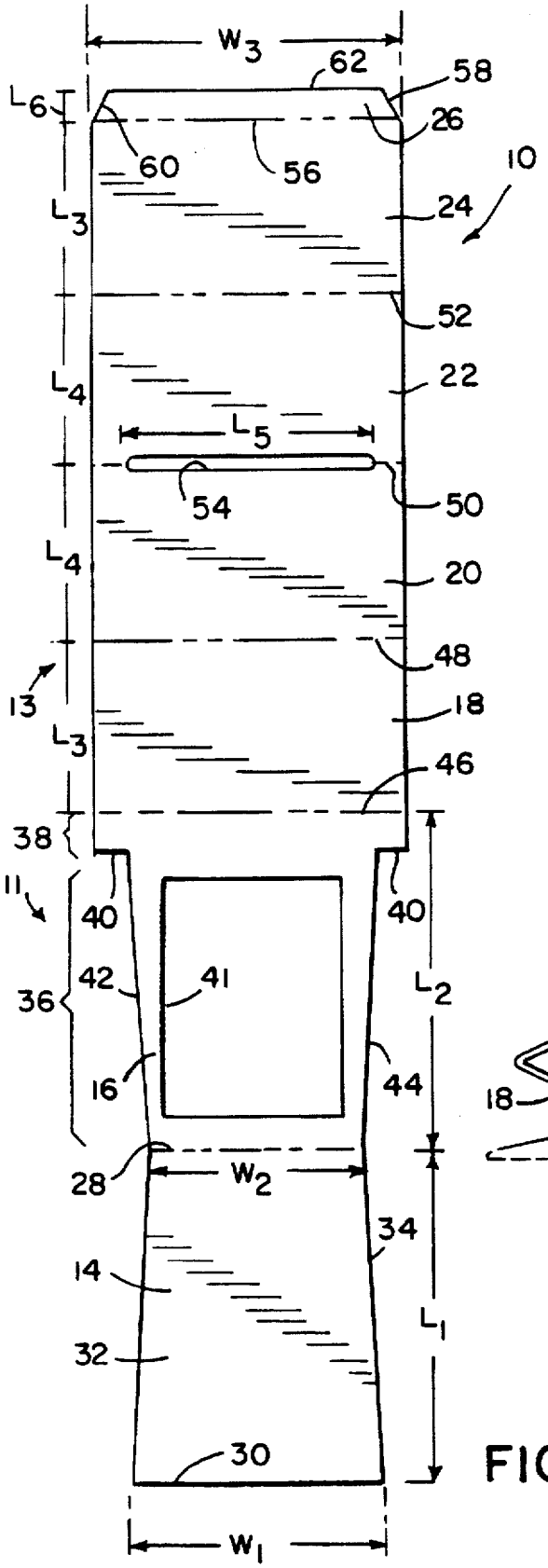
FIG. 1
FIG. 4
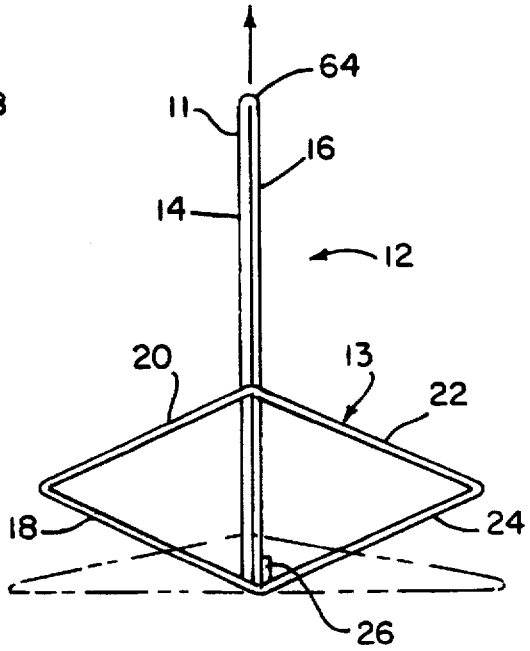

POP-UP FRAMING DEVICE

BACKGROUND OF THE INVENTION

The present invention relates to collapsible frames, and more particularly to frames which can be used to store a picture, baseball card, or similar item, and also to support the item for viewing.

There are many known devices that are suitable for the purpose of displaying a picture, a card, or other similar flat item in an upright position for viewing. Some of these can also double as a storage device for the item.

Particularly inexpensive devices are formed out of one or more pieces of cardboard. For example, U.S. Pat. No. 5,479,732 describes a device formed of a single blank that can be configured to vertically support a single display panel. In addition to supporting the panel for viewing, this device can be folded into a covering configuration where the panel is protected by other panels for storage.

Unfortunately, to display a picture or card using this device the picture or card must either be printed on the display panel or adhered to a surface thereof. This can alter the condition of the display item. This is particularly troublesome where a display item can lose significant value when altered even slightly from its original condition.

In addition, where an item is mounted on a display panel, information on the back of the item is unobservable. In the case of a baseball card, this limitation is a particular problem as such cards typically have statistics on their back side.

Another inexpensive display/storage device is described in U.S. Pat. No. 5,287,641. This device includes a display portion that provides a frame. While this device may be reusable and can be used without damaging a display item, this device is disadvantageous as a plurality of pieces are required to construct it. In addition, it cannot vertically support a display item for viewing.

Other known devices are disadvantageous because they require several components, include only a single vertical display panel, cannot vertically display an item, and/or have other limitations. Therefore, a need exists for an improved frame for photos, cards, and the like.

BRIEF SUMMARY OF THE INVENTION

The present invention provides a frame having a display portion including a frame panel and a frame backing panel integrally attached to each other along a foldline. A support portion is integrally attached to the display portion and has first and second serially arranged pairs of support panels separated by foldlines. The support panels form a support opening along a foldline separating the two pairs of support panels.

The display and support portions are moveable between a covering configuration wherein the pairs of support panels lie flat on opposite sides of the display panels so that a majority (e.g. 90% or more) of the display portion is covered (and protected) by the support portion, and a display configuration wherein each pair of support panels forms an angle with the other pair to form a support base and the display portion projects through the support opening so as to be supported by the base.

Preferably, a proximal end of the display portion is integrally connected to the support portion, a central region of the display portion extends through the support opening when the device is in the display position, and the central region has a smaller width than the proximal end. If desired, one of the display panels can include a tongue portion and a base portion that extends outwardly on both sides of the tongue portion to form support shoulders. The tongue portion adjacent the shoulders can have essentially the same width as the support opening.

In other preferred aspects the support portion can include an end panel connected along a foldline to one of the support panels which is secured to the base portion or to a portion of a support panel adjacent the base panel; when the frame is in the display configuration two support panels form a bottom surface that is substantially perpendicular to the display portion; and the support opening is centrally located along the length of the foldline between support panel pairs.

Also, the frames (and blanks described below) can have been made from a foldable blank which had the frame panel positioned between the frame backing panel and a support panel.

The frames can also have modifications to the support opening area to create a bendable tab to accommodate a longer display portion, or lock projections to interfit with the display to hold the frame in the display configuration.

In another aspect, the invention provides the foldable blank. The blank has a display portion including a frame panel and a frame backing panel, each being connected to the other along a foldline. There is also a support portion including first, second, third and fourth support panels, the first support panel being connected along a foldline to the display portion, the second support panel being connected along a foldline to the first support panel opposite the display portion, the third support panel being connected along a foldline to the second support panel opposite the first support panel, and the fourth support panel being connected along a foldline to the third support panel opposite the second support panel. The second and third support panels together form a support opening along their common foldline. In addition, there is an end panel connected along a foldline to either the fourth support panel opposite the third support panel or to the display portion.

In preferred forms of the blank the frame panel is adjacent the first panel; one of the display panels includes a tongue portion and a base portion extending outwardly on both sides of the tongue portion to support shoulders, and the tongue portion is adjacent the foldline between the first and second display panels; the foldline between the display panels is a common foldline; and the width of each display panel is less adjacent the common foldline than at panel edges opposite the common foldline.

In alternative forms of the blank, the first support panel is connected to the frame panel adjacent the base portion. Also, the end panel is connected to the fourth support panel; the support opening is located along the foldline between support panel pairs; and the frame backing panel has a display opening through it.

It will be appreciated that the present device includes two display panels. A display item can be wedged between the two display panels when they are folded to cover each other and pinched together by the support opening. This eliminates the need for glue to contact the display item or the need to print the display information on a display panel.

A primary object of the invention is to provide a simple and inexpensive single piece blank that can easily be folded into a frame. To this end, the inventive blank can be formed from a single piece of cardboard.

Another object of the invention is to provide a frame which can be moved between a storage/covering configuration and a display configuration.

Another object is to provide a reusable display device in which the picture or card can be changed without adversely affecting the frame.

Yet another object is to provide a device that meets all of the aforementioned objects yet allows both sides of the display item to be viewed when in the display configuration. To this end, each of the display panels can be provided with display openings.

Still other objects of the present invention will become apparent during the course of the following description and by reference to the accompanying drawings. Thus, the claims should be looked to in order to judge the full scope of the invention.

BRIEF DESCRIPTION OF THE DRAWINGS

FIG. 1 is a plan view of a blank of the present invention;

FIG. 4 is an end elevational view showing the device of FIG. 3 in an intermediate configuration, with the display configuration being shown in dashed lines;

DETAILED DESCRIPTION

Figure 3:
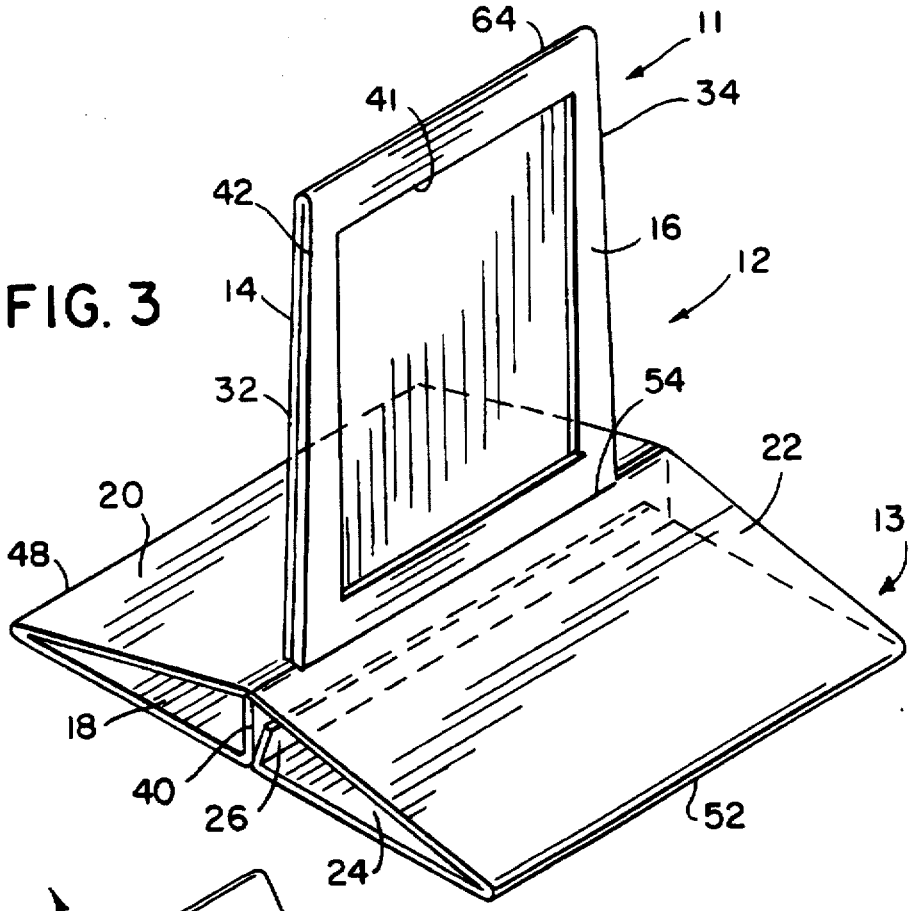
FIG. 3 is a perspective view of the blank in FIG. 1 in a later stage of assembly.

A blank 10 (FIG. 1) can be formed out of paper board, cardboard or other foldable materials. When assembled, the blank forms the framing device 12 shown in FIGS. 3–5.

The blank 10 is provided with a plurality of foldlines that define display and support portions 11, 13. The display portion 11 includes a frame backing panel 14 and frame panel 16. The support portion 13 includes first, second, third and fourth support panels 18, 20, 22 and 24. There is also an end gluing panel 26.

In a preferred embodiment, backing panel 14 has an edge defined by foldline 28, an edge 30 which is parallel to and opposite foldline 28, and two oppositely facing lateral edges 32, 34 that traverse the distance between the foldline 28 and the lower edge 30. Preferably, the backing panel 14 is shaped so as to have a width $W_1$ along edge 30 which is slightly greater than the width $W_2$ along foldline 28. The first display panel has a length $L_1$.

The frame panel 16 preferably includes a tongue portion 36 and a base portion 38. The tongue portion 36 has a shape that is similar to the shape of the first display panel 14 (except for opening 41). That is, the tongue portion 36 is connected to the backing panel 14 along foldline 28 and has lateral edges 42, 44 that are similar to the lateral edges 32, 34 of the first display panel 14 in that they slope from foldline 28 at a similar angle as they approach a frame panel edge (i.e. foldline 46) opposite foldline 28. Thus, when the backing panel 14 is folded along foldline 28 so that it rests against the frame panel 16, the lateral edges 32, 34 of the first display panel 14 align with the lateral edges 42, 44 of the tongue portion 36. (See generally FIG. 2). As noted above, tongue portion 36 has a centrally located opening or aperture 41. When a photo, card, or other item (not shown) is slid between these display panels, the opening 41 permits viewing thereof.

The base portion 38 extends laterally outwardly on both sides of the tongue portion 36 at an end of the frame panel 16 opposite foldline 28. Thus, the base portion 38 forms two shoulders, one shoulder on either side of the tongue portion 36. The overall length $L_2$ of the frame panel 16 is slightly greater than the length $L_1$ of the backing panel 14.

Referring still to FIG. 1, the first, second, third and fourth support panels 18, 20, 22 and 24 have substantially identical width dimensions which are identical to the width of the base portion 38. Support panels 18 and 24 have identical lengths $L_3$ and support panels 20 and 22 also have identical lengths $L_4$. Preferably, the sum of lengths $L_3$ and $L_4$ is substantially equal to the length $L_2$ of the frame panel. The first and second support panels 18, 20 together form a first support panel pair, while the third and fourth support panels 22, 24 form a second support panel pair.

The first support panel 18 is connected to the frame panel 16 along a foldline 46 opposite foldline 28. The second support panel 20 is connected to the first support panel 18 along foldline 48 opposite foldline 46, the third support panel 22 is connected to the second support panel 20 along foldline 50 opposite foldline 48, and the fourth support panel 24 is connected to the third support panel 22 along foldline 52 opposite foldline 50.

Along foldline 50 the second and third support panels 20 and 22 form a support opening 54 which preferably has a uniform width and has a length $L_5$ that is substantially equal to the width $W_1$ of the edge 30 of the backing panel 14.

End panel 26 is connected along foldline 56 to the fourth support panel 24 opposite the third support panel 22. Preferably, the end panel 26 has a length $L_6$ which is slightly less than the length of the base portion 38 and the edges 58, 60 of the end panel 26 taper inwardly from foldline 56 to a distal edge 62.

When referring below to any of the panels, the phrase "internal surface" will be used to describe the surface shown in FIG. 4 whereas the phrase "external surface" will be used to describe surfaces facing in the opposite direction that are hidden in FIG. 1.

Figure 2:
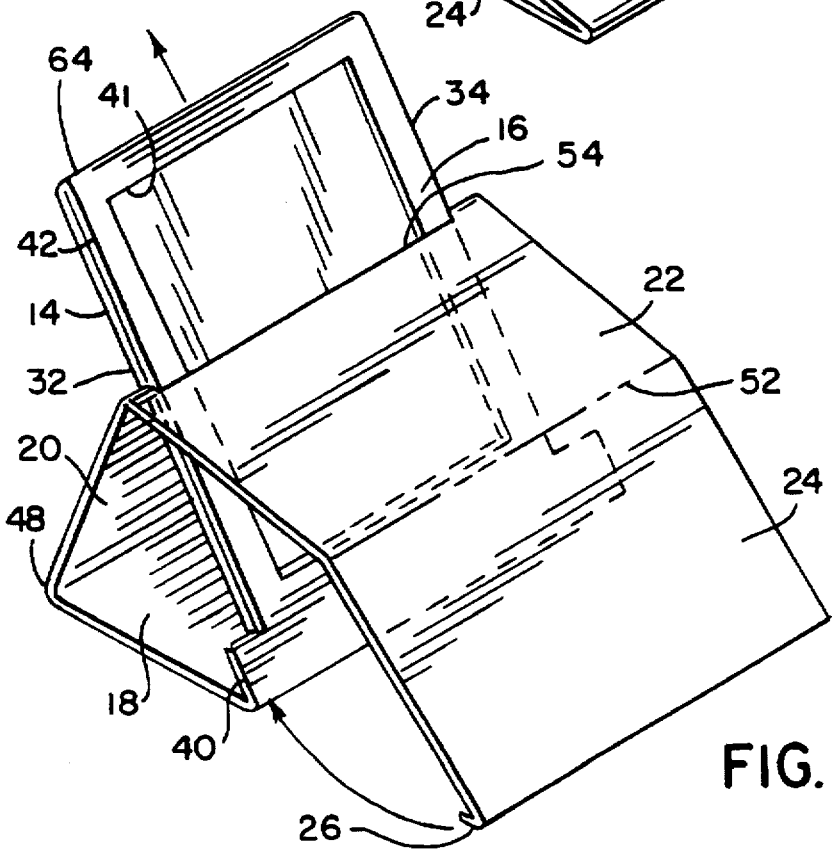
FIG. 2 is a perspective view showing the blank of FIG. 1 partially assembled.

Referring now to FIGS. 1–5, in folding the blank 10 to form the framing device 12, the backing panel 14 is first folded along foldline 28 so that it is parallel to the framing panel 16 and the internal surfaces of the two display panels 14, 16 are adjacent. As seen in FIGS. 2 and 3, when so folded, the edges 32, 34 are aligned with the edges 42, 44.

A small amount of glue can be provided on the internal surface of the base portion 38 prior to folding so that after folding the internal surface of the lower edge 30 can be pressed against the base portion 38 until the glue therebetween has cured to secure the base portion 38 and the lower edge 30. No glue is needed along edges 42, 44.

Next, the display is as a unit folded along foldline 46 until they are parallel to the first support panel pair 18, 20 and the external surface of the portion 14 is adjacent the internal surface of the first support panel pair 18 and 20.

At this point the end panel 58 can be folded along foldline 56 so that it is parallel with the fourth support panel 24 and its internal surface is adjacent the internal surface of the fourth support panel 24. A ribbon of glue can then be placed on the external surface of the end panel 26.

Next, the second display panel 20 can be folded along foldline 50 until the first support panel pair 18, 20, and display portions are all parallel to the second support panel pair 22, 24 and the external surface of the second display panel 16 is adjacent the internal surfaces of the third and fourth support panels 22, 24. At this point, the external surface of the end panel 26 will be adjacent the external surface of the base portion 38 and can be pressed thereagainst to glue the two surfaces together.

Figure 5:
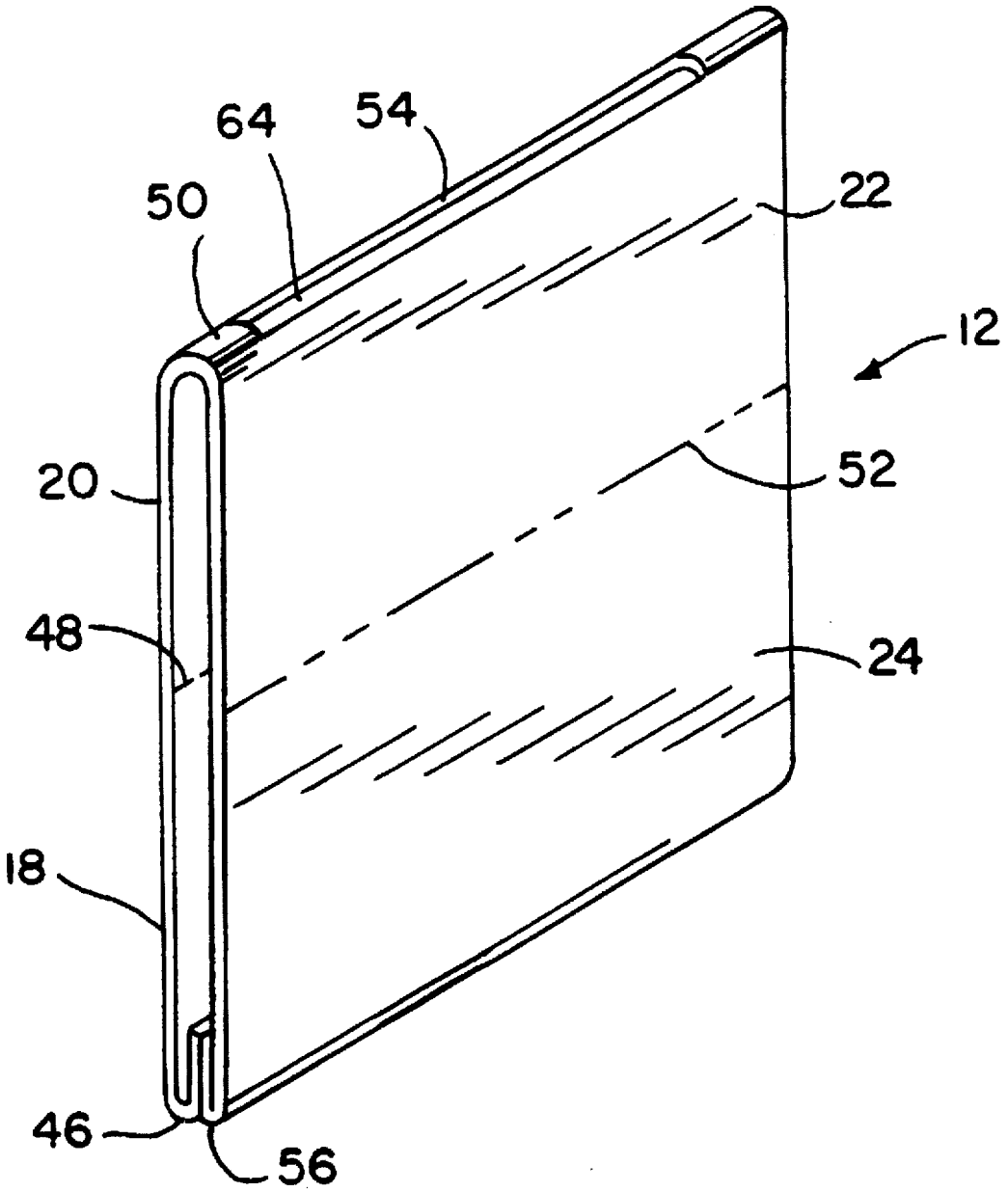
FIG. 5 is a perspective view of the device of FIG. 3 in a storage/covering configuration.

After the glue between panels has cured, the display device is completely assembled and is in the storage configuration shown in FIG. 5. When so configured, the display portion is completely encased inside the support panels 18, 20, 22, 24 and a distal end 64 of the display portion 11 is aligned with the support opening 54.

To move the display portion 11 into a display configuration, the first and second support panels 18, 20 and the third and fourth support panels 22, 24 can be simultaneously folded along foldlines 48 and 52, respectively. When so folded, the distal end 64 can be periscoped up through the support opening 54. Because the display portion is tapered the display portion 11 has a reduced width (i.e. $W_1$) at its distal end 64 which helps to align the distal end 64 with the support opening 54. As the support panels 18, 20, 22, 24 are folded around foldlines 48 and 52 to a further degree, the distal end 64 continues to extend through the support opening 54 until, as seen in FIGS. 3 and 4, the first and fourth support panels 18, 24 are substantially horizontal and perpendicular to the display portion. In this orientation, shoulders 40 abut against the internal surface of foldline 50 and stop further movement of the display portion through the support opening 54. As seen in FIG. 4, in the display configuration support panels 20 and 22 form braces for the display portion 11.

Once in the display configuration, a picture, card or other similarly shaped flat item can be slid between the two display panels 14, 16 and viewed through display opening 41. When the display portion 11 extends through support opening 54, the external surfaces of the display portion abut the edges of the support opening 54 causing friction and limiting unintentional device movement of the item being framed.

To move the display portion from the display configuration shown in FIG. 3 back to the storage configuration shown in FIG. 5, the display portion is simply pushed back through the support opening 54 while the support panels 18, 20, 22, 24 are again forced into a parallel relationship.

It should be appreciated that an inexpensive frame has been described. Although the present invention has been described in relation to a specific preferred embodiment, it should be understood that one skilled in the art could make variations and modifications to the preferred embodiment without departing from the scope and spirit of this invention. For example, while the display panels 14, 16 are described as having a tapering width, each could have a uniform width. See e.g. FIGS. 6 and 7. Moreover, the unit could have other sizes (e.g. to accommodate a 5"×7" photo). In addition, the aperture or display opening 41 need not be rectangular. Instead, it could be circular, oval or some other shape. See e.g. FIG. 6.

More than one display opening 41 could be provided, or, in the alternative, one display opening could be provided in the display panel 16 while another opening could be provided in the first display panel 14. This would be advantageous where a display item (i.e. a baseball card) includes viewable information on two sides or where two items are to be viewed.

It should also be understood that end panel 26 could instead be provided on edge 30 of the backing insert panel 14. Moreover, while it is preferable that glue be used to secure parts of the invention, the end panel 26 could be secured to the display portion 11 in some other manner (e.g. tape). Also, the frame panel could instead be panel 42, with panel 41 then being the backing panel (albeit this makes use of automated folding equipment more difficult).

Figure 6:
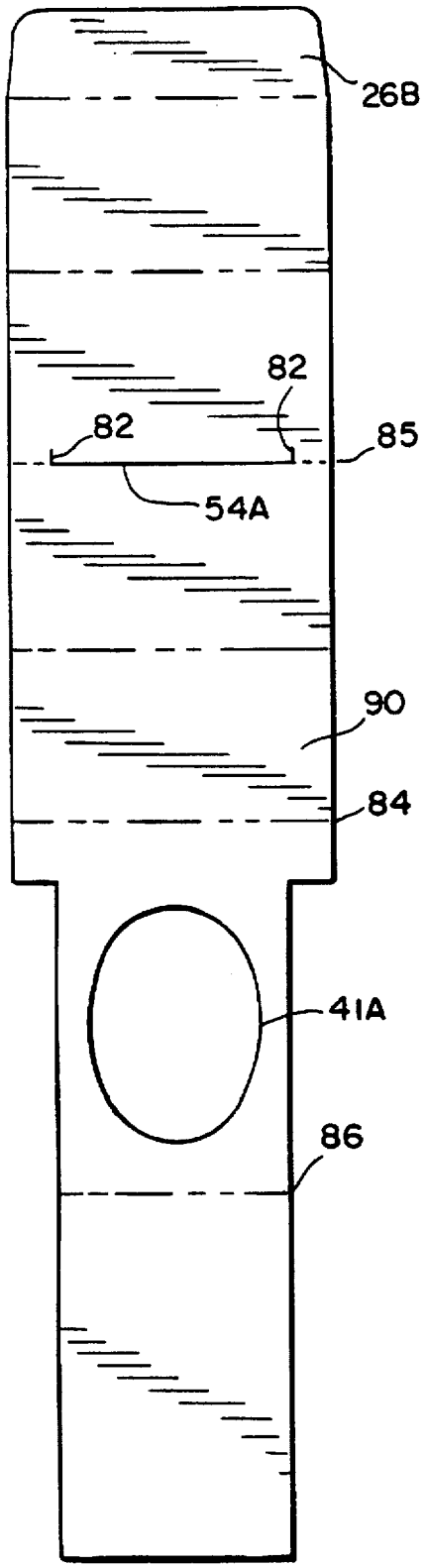
FIG. 6 is a second embodiment from a view similar to FIG. 1.

FIG. 6 is also illustrative of several alternative features. Narrow slit 54A is terminated by axial slits 82 on each side. This creates a bendable tab at foldline 85. The distance between foldlines 84 to 86 is slightly greater than the distance between foldlines 84 to 85. were it not for the bendable tab one would have to bend the frame in order to cause its foldline 86 to pass through slot 54A.

The tab itself bends back as the longer portion 86 is inserted and thereby prevents damage to the frame. It also assists in a friction fit. The reason for this modification is that in some embodiments it may be desirable in the covered configuration to have a leading edge of the frame project outward. This avoids the need for tapered sides like those at 42 and 44 of FIG. 1 along with a widened slot 54 of FIG. 1.

Another change is that the glue flap 26B is larger and glued on the outside bottom surface of the support rather than bending it upward as shown in FIG. 4 and gluing it alongside a display portion. This embodiment has the additional advantage that if one wishes to extend the panel 26B even farther one can provide it with a perforated tear off coupon portion (not shown).

Figure 7:
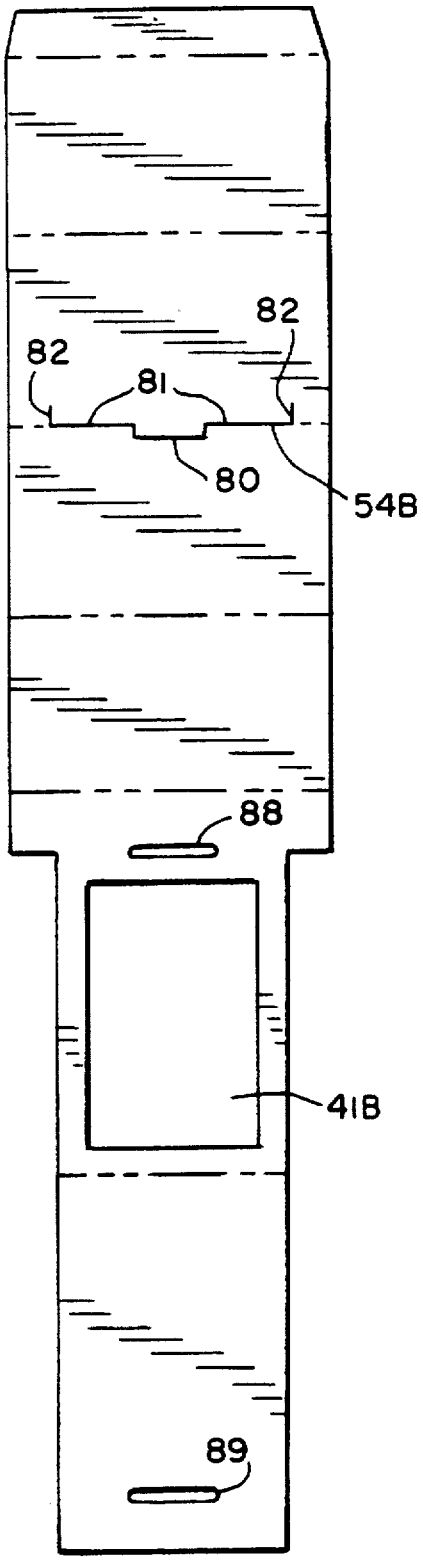
FIG. 7 is a third embodiment from a view similar to FIG. 1.

FIG. 7 is similar to FIG. 6. However, aside from having a rectangular opening 41B it has a slightly different tab-like arrangement defined by cut 54B, end cuts 82, and 81.

This embodiment also has a locking system. An additional projection 80 is formed on the end of the bendable tab. There are also corresponding receiving holes 88 and 89 on the display portion. When the display portion is pushed through the central slit the projection 80 pops into slots 88 and 89 so as to inhibit return movement to the covering configuration.

In order to advise the public of the various other embodiments that may fall within the scope of the invention, the following claims are made.

We claim:

1. A frame made from a foldable blank, comprising:

a display portion including a frame panel and a frame backing panel integrally attached to each other along a foldline;

a support portion integrally attached to the display portion at a foldline and including first and second serially arranged pairs of support panels separated by foldlines, the support panels forming a support opening along a foldline separating the first and second pairs of support panels;

wherein the display and support portions are moveable between a covering configuration wherein the pairs of support panels lie flat on opposite sides of the display portion so that a majority of the display portion is covered by the support portion, and a display configuration wherein each pair of support panels forms an angle with the other pair to form a support base and the display portion extends through the support opening so as to be supported by the base; and wherein a portion of the support opening defines an end of a bendable tab, the tab being part of a specified support panel that is on an opposite side of the support opening from the foldline between the display portion and the support portion, lateral sides of the tab being defined by slits extending from the support opening in a direction away from the foldline between the display portion and the support portion, the tab being configured to bend outward relative to a remainder of the specified support panel to enlarge the support opening as the display portion is first inserted through the support opening; and wherein the display portion is longer than a collective length of two support panels that are positioned between the support opening and the display portion.

2. The frame of claim 1, wherein a proximal end of the display portion is integrally connected to the support portion, a central region of the display portion projects through the support opening when the frame is in the display position, and the central region has a smaller width than the proximal end.

3. The frame of claim 1, wherein one of the display panels includes a tongue portion and a base portion that extends outwardly on both sides of the tongue portion to form support shoulders, and the tongue portion adjacent the shoulders has essentially the same width as the support opening.

4. The frame of claim 1, wherein the support portion further includes an end panel connected along a foldline to one of the support panels, the end panel also being secured to a second support panel.

5. The frame of claim 1, wherein when the frame is in the display configuration two support panels form a bottom surface that is substantially perpendicular to the display portion.

6. The frame of claim 1, wherein the support opening is centrally located along a length of the foldline between the first and second pairs of support panels.

7. The frame of claim 1, wherein the frame is made from a foldable blank that had the frame panel positioned between the frame backing panel and a support panel.

8. The frame of claim 1, wherein in the covering configuration at least 90% of an axial length of the display portion is covered by the support portion.

9. The frame of claim 1, wherein the display portion has a slot and the support has a tab that is adjacent the support opening and can interfit with the display portion slot when the frame is in the display configuration.

10. A foldable blank for forming a frame, the blank comprising:

a display portion including a frame panel and a frame backing panel, each being connected to the other along a foldline;

a support portion including first, second, third and fourth support panels, the first support panel being connected along a foldline to the display portion, the second support panel being connected along a foldline to the first support panel opposite the display portion, the third support panel being connected along a foldline to the second support panel opposite the first support panel, and the fourth support panel being connected along a foldline to the third support panel opposite the second support panel, the second and third support panels together forming a support opening along their common foldline; and an end panel being connected along a foldline to either the fourth support panel opposite the third support panel or to the display portion;

wherein a portion of the support opening adjacent the foldline between the second and third support panels defines an end of a bendable tab, the tab being part of the third support panel, lateral sides of the tab being defined by slits extending from the support opening in a direction away from the foldline between the display portion and the support portion, the tab being configured to bend outward relative to a remainder of the third support panel to enlarge the support as the display portion is first inserted through the support opening; and wherein the display portion is longer than a collective length of the first and second support panels that are positioned between the support opening and the display portion.

11. The blank of claim 10, wherein the frame panel is adjacent the first panel.

12. The blank of claim 10, wherein one of the frame panel and frame backing panel includes a tongue portion and a base portion extending outwardly on both sides of the tongue portion to form shoulders and the tongue portion is adjacent the foldline between the frame panel and frame backing panel.

13. The blank of claim 10, wherein the end panel is connected to the fourth support panel.

14. The blank of claim 10, wherein the display portion has a slot and the support portion has a tab that is adjacent the support opening and sized so as to be capable of fitting in the slot.

* * * * *